US008262157B2

(12) United States Patent
Novak

(10) Patent No.: US 8,262,157 B2
(45) Date of Patent: Sep. 11, 2012

(54) HINGE COLLAPSIBLE PORTABLE SLAT SEAT

(76) Inventor: Leslie Aisner Novak, Newburyport, MA (US)

( * ) Notice: Subject to any disclaimer, the term of this patent is extended or adjusted under 35 U.S.C. 154(b) by 384 days.

(21) Appl. No.: 12/626,156

(22) Filed: Nov. 25, 2009

(65) Prior Publication Data

US 2011/0124953 A1 May 26, 2011

(51) Int. Cl.
*A47C 4/00* (2006.01)
*A47C 7/02* (2006.01)
*A47C 7/16* (2006.01)

(52) U.S. Cl. ..... 297/16.2; 297/17; 297/230.1; 297/352; 297/378.1; 297/382; 297/452.63

(58) Field of Classification Search ..... 297/16.2, 297/230.1, 230.11, 230.12, 230.13, 255, 297/352, 378.1, 17, 380, 382, 452.63
See application file for complete search history.

(56) References Cited

U.S. PATENT DOCUMENTS

| | | | | |
|---|---|---|---|---|
| 2,001,252 | A | 6/1931 | Johnson | |
| 2,078,396 | A * | 4/1937 | Macewan | 297/352 X |
| 2,306,673 | A * | 12/1942 | Tucker | 297/252 |
| 2,457,978 | A * | 1/1949 | Curran | 297/350 |
| 2,607,400 | A * | 8/1952 | Witz | 297/380 |
| 2,734,556 | A * | 2/1956 | Hebrank | 297/230.1 |
| 3,032,916 | A * | 5/1962 | Oakes | 297/382 X |
| 3,063,753 | A * | 11/1962 | Mitchell | 297/382 X |
| 3,323,151 | A * | 6/1967 | Lerman | 297/382 X |
| 3,602,548 | A * | 8/1971 | Grams | 297/452.16 |
| 4,077,669 | A * | 3/1978 | Fox | 297/452.48 |
| 4,313,640 | A * | 2/1982 | Trotman et al. | 297/452.45 |
| 4,662,851 | A * | 5/1987 | Foster | 441/129 |
| 4,824,171 | A * | 4/1989 | Hollingsworth | 297/351 |
| 5,100,203 | A | 3/1992 | Novak | |
| 5,385,390 | A * | 1/1995 | Freeman et al. | 297/17 X |
| 5,474,361 | A * | 12/1995 | Hwang et al. | 297/380 |
| 5,785,427 | A * | 7/1998 | Godshaw | 383/4 |
| 6,058,535 | A * | 5/2000 | Firkins et al. | 297/219.1 X |
| 6,164,726 | A * | 12/2000 | Reeves et al. | 297/16.2 X |
| 6,908,151 | B2 * | 6/2005 | Meeker et al. | 297/250.1 |
| 7,438,356 | B2 * | 10/2008 | Howman et al. | 297/352 X |
| 7,571,965 | B1 * | 8/2009 | Perry | 297/452.26 |
| 7,585,030 | B2 * | 9/2009 | Galbreath et al. | 297/452.27 |
| 7,637,568 | B2 * | 12/2009 | Meeker et al. | 297/230.14 X |
| 7,810,192 | B2 * | 10/2010 | Fujita et al. | 5/636 |
| 2007/0035169 | A1 * | 2/2007 | Sawyer | 297/382 |

* cited by examiner

*Primary Examiner* — Rodney B White
(74) *Attorney, Agent, or Firm* — McKee, Voorhees & Sease, P.L.C.

(57) ABSTRACT

A collapsible and foldable composite chair with back slats and seat slats held together by a fabric material. A fold line hinge into the fabric material which normally wears out over time is reinforced to prevent such early wear outs with a cell foam material, preferably a closed cell polyolefin strip. As a result the slats do not wear though the slat pockets in the material and the fold line hinge endures.

12 Claims, 2 Drawing Sheets

HINGE COLLAPSIBLE PORTABLE SLAT SEAT

This invention relates to a an improvement in collapsible portable slat seats of the type generally described in Johnson U.S. Pat. No. 2,001,252 issued May 14, 1935 and improved upon in my earlier U.S. Pat. No. 5,100,203 of Mar. 31, 1992.

BACKGROUND OF THE INVENTION

Generally speaking, these types of foldable slat chairs involve a relatively simple collapsible and foldable composite chair with a back and a seat, and the back and the seat each are formed primarily of a series of parallel slats held in co-active relation to each other by fabric and lateral straps extending from the seat portion to the back portion. As a result, the portable seat may be in conventional chair use on the ground or floor or upright position, and may be in collapsed and rolled up, non-use storage position (see FIG. 7 of my prior patent).

Chairs of the type generally referred to in the Johnson Patent have met with some degree of success in the past for use at sporting events, on the beach, and the like. They are easily toted, easily set up, highly functional and lightweight for ease of use.

Applicant has been in the business of manufacture and sale of such chairs for nearly twenty years. In that twenty-year period of time, a number of noteworthy observational use and construction advances have been made. For example, my earlier U.S. Pat. No. 5,100,203 dealt with problems arising in slat insertion and maintenance within the pockets in the fabric material. Over the years it has been observed that one constructional weakness of the chairs relates to fabric material along the chair fold line as being subject to continual wear as the black slats push down in the fabric pockets and as the bottom slats push backwards in their respective pockets, and as well as while the back and the bottom are folded up and down along the fold line. In particular, this material wears under such continual abrasive movement, making it eventually wear through the seat, rendering it useless. Through the years there have been many attempts to improve the fold line hinge wear resistance. These attempts have varied from using different material than canvas, such as vinyl and vinyl covered canvas. Even experimentation with a hinge other than a living hinge, has been done. The difficulty arising in solving the problem is that the material must be comfortable against the user's skin and at the same time must be consistent with the chair's simplicity and lightweight durability, which must not be sacrificed; finally the chair must be environmentally safe (green). The latter point is especially important to recent new uses for the child-size chairs, as explained below.

In particular, Applicant has discovered that child sized chairs are especially useful for special needs children that are autistic and/or suffer from disfunctioning sensory process disorders, such as ADD, ADHD, Autistic spectrum disorders, RAD, Downs Syndrome and CP. In particular, many such children, when engaged in group school activities, are distracted by sensory overload creating hyperactivity, restlessness, difficulty in staying seated, and in staying focused on the group activity. It has recently been discovered that these portable slat chairs when made in children size, and when used with children having the above described issues or disorders, have a positive effect on the child's arousal level and attention. In particular, the child can sit in the chair, engage in group circle activities, and gently rock back and forth, giving herself a hugging effect (deep sensory input) from the chair.

As a result, teachers have noticed increased attention, quieter children and better focused, circle group efforts.

But here again the child's rocking both back and forth and side to side, as such challenged children are known to do, creates even more wear and tear on the chair and accentuates the problems such as the need for a durable hinge. Put another way, the confinement factor of the chair, coupled with the "self hug" are the calming factor, but at some sacrifice to chair wear. The current chair with its improved hinge better withstands this type of use, as well as other abuses normally resulting in wear or tear.

It is accordingly a primary objective of the present invention to improve on collapsible portable slat seats by providing such a foldable seat having an improved, more wear resistant hinge.

It is another objective of the present invention to provide such a hinge which does not sacrifice comfort, or in the case of use by challenged children, does not detract from the calming hug effect that the chair imparts to them.

A yet further objective of the present invention is to provide the improved wear resistant hinge in a manner which does not significantly increase cost and in a manner which can efficiently be inserted into the manufacturing process without unduly complicating the manufacturing process.

A still further objective is to provide a method or system which provides deep pressure sensory integration for special needs children having sensory process disorders.

The above objectives as well as others can be accomplished by the methods and description of the present invention which hereinafter follow. It will be appreciated that the examples here are illustrative only and the true measure of the invention is defined by the claims.

BRIEF SUMMARY OF THE INVENTION

A collapsible and foldable composite chair with back slats and seat slats held together by a fabric material. A fold line hinge into the fabric material which normally wears out over time is reinforced to prevent such early wear outs with a closed cell foam material, preferably a closed cell polyolefin strip. As a result the slats do not wear though the slat pockets in the material and the fold line hinge endures, as comfort and deep pressure sensory perception is increased.

DETAILED DESCRIPTION OF A PREFERRED EMBODIMENT

Figure 1:
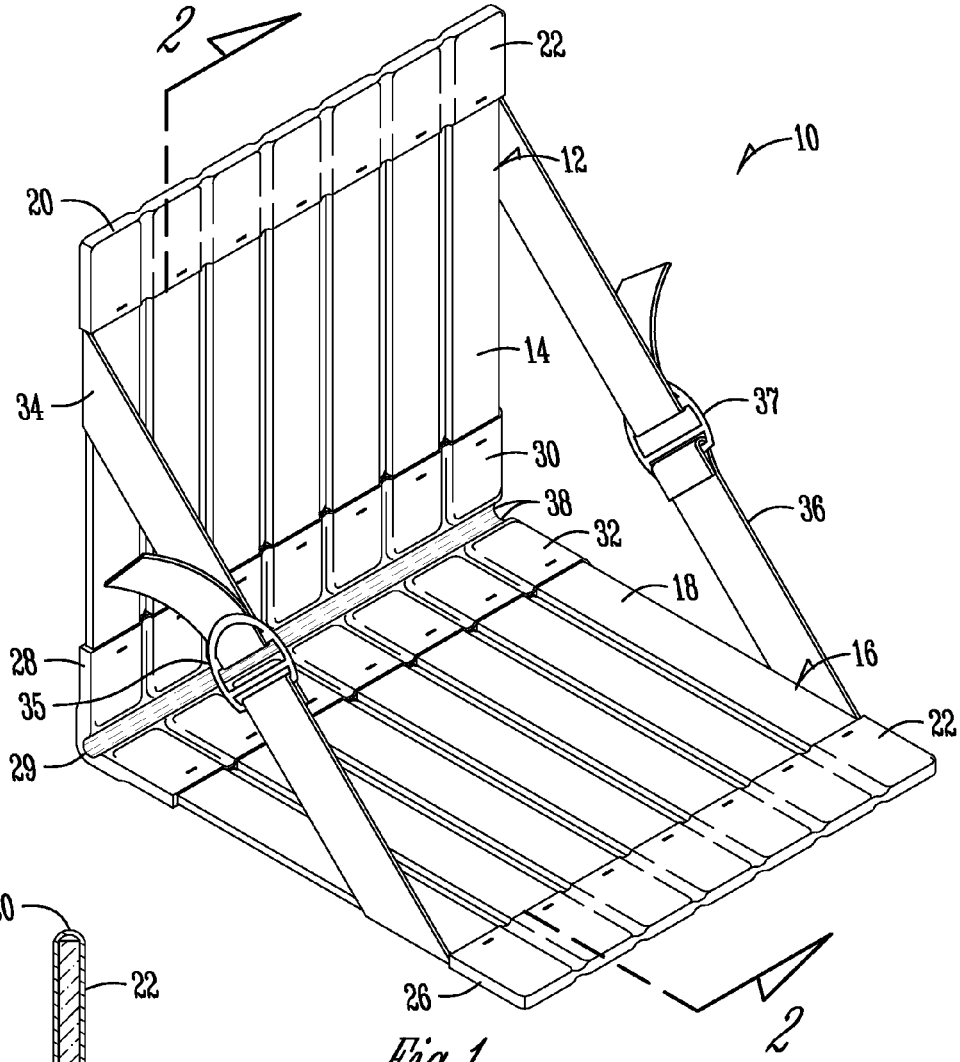
FIG. 1 is a perspective view of the collapsible chair of this invention.
Figure 2:
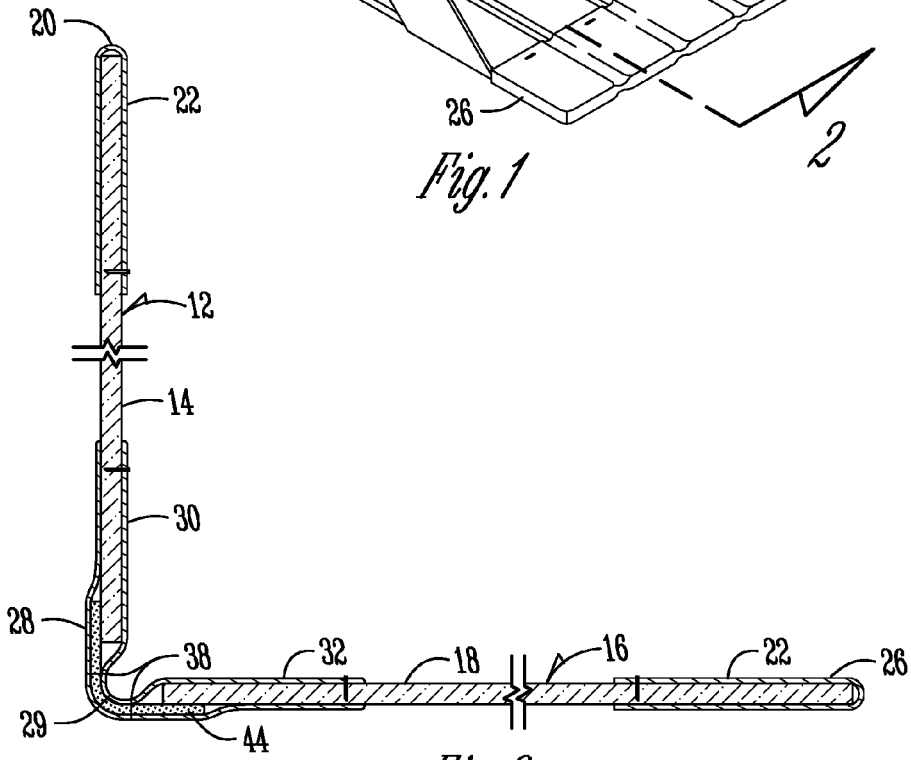
FIG. 2 is an elevated side view of the chair of the present invention.

FIG. 1 shows the chair 10 in use position. There it can be seen that the back 12 of chair 10 consists of a plurality of substantially parallel slats 14. In similar fashion, the seat 16 consists of a series of substantially parallel slats 18. Preferably, slats 14 and 18 are made of basswood, although other suitable structural materials would work as well. A first flexible connecting material 20, which ideally is canvas, extends over one end of the slats 14 and has a series of pockets 22 formed in the fabric material 20, particularly defined by stitching 24.

A second flexible material 26 is similarly configured and stitched to one end of the seat slats 18 in similar fashion.

A third flexible connector fabric material piece 28 is stitched to form a fold line 29, to define a series of inner back pockets 30 and inner seat pockets 32, and generally folded to form a canvas fabric living hinge with pockets 30, 32 for the seat and back slats, 18 and 14.

Lateral or side straps 34 and 36 can be formed of canvas (cotton) webbing and generally holds the back 12 in proper relation to the seat 16 when in use. The chain 10 can be collapsed along fold line 29 and rolled to an at-rest or storage position, as illustrated in FIG. 7 of my prior U.S. Pat. No. 5,100,203, which is incorporated herein by reference.

As seen in FIG. 1, side straps 34 and 36, have adjustable buckles 35 and 37. This is particularly important in the children's size which can be strapped down to create a tighter, more secure feeling, particularly for challenged children having autistic issues or attention deficit disorder. This enhances the hug and calming effect of the chair.

Figure 3:
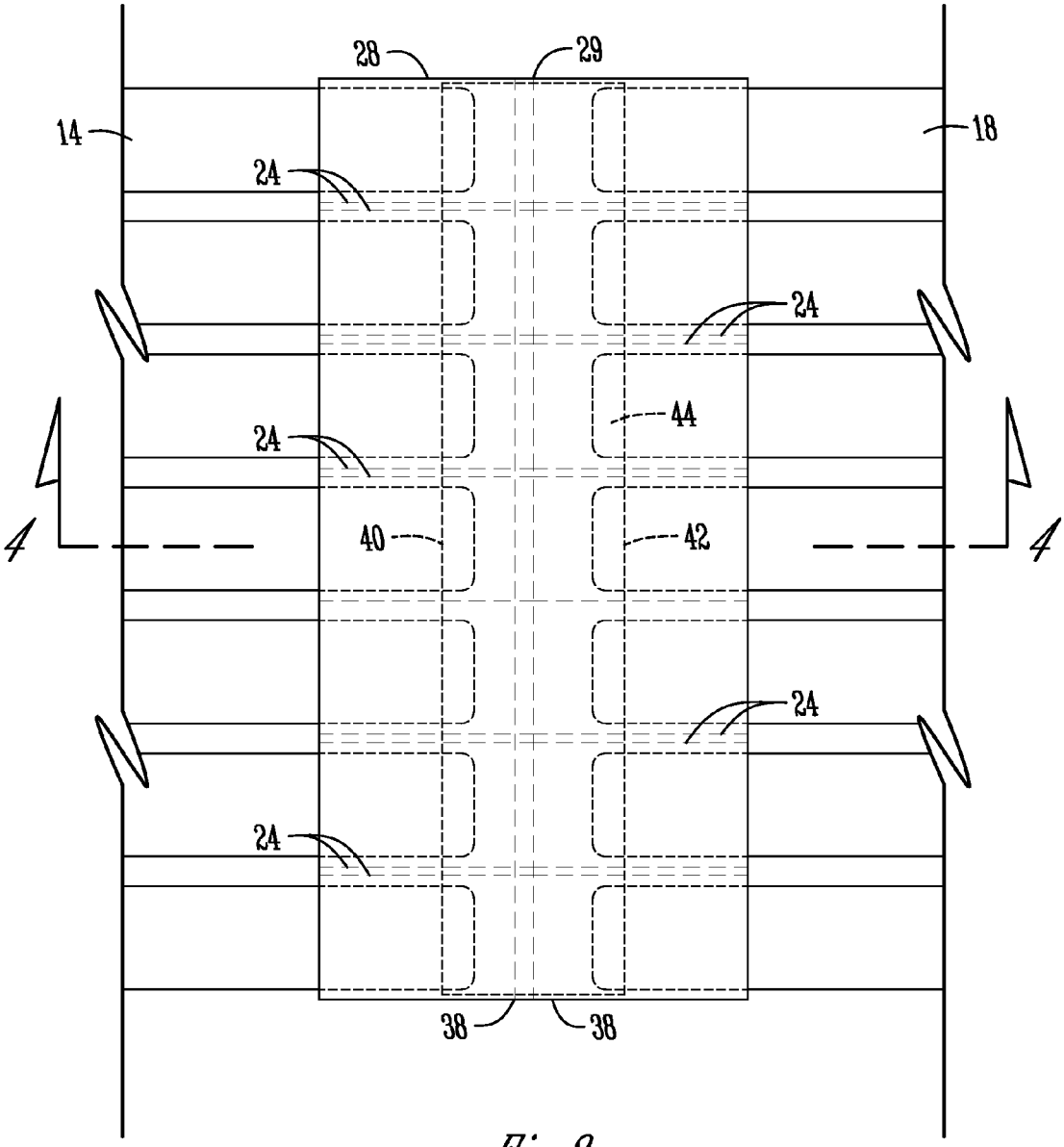
FIG. 3 is a plan view of the laid-flat connector piece of fabric that is folded along a fold line to define the fabric hinge.

FIG. 3 is a top view of the laid flat third flexible connector fabric piece 28. As seen, it is stitched down the center line defined by fold line 29 and by stitches 38, and it is stitched intermittently along the lateral sides 40 and 42 exteriorly and interiorly at 44 and 46 to define the pockets 30, 32. Fold line 29 is reinforced by the center line stitch 38 and is further reinforced by having at its interior surface, a center strip 44. The center is a foam cushion strip 44 and lays along the long axis of the fold line 29. It is preferably a foam cushion closed cell foam material, and it is most preferably, a closed cell polyolefin foam strip. One material that is especially suitable is a strip with an adhesive on one side, so that it may be laid over the fold line 29 during formation of the flexible connector material piece 28 and then adhered to an interior surface of the canvas on one side, before stitching occurs. Thus when the seat 10 is folded along fold line 29 and along center line stitch 38, half of the foam material is with the back side and one half of the foam material is with the seat side with it folded along fold line 29.

Figure 4:
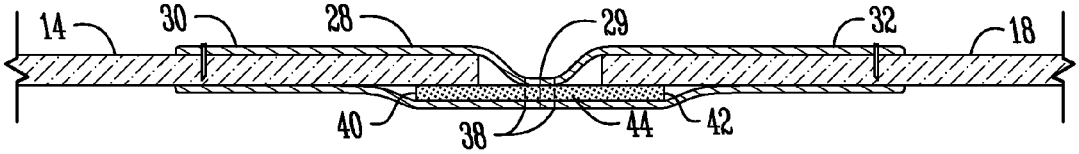
FIG. 4 is a sectional view along line 4-4 of FIG. 3 to show the constructional features of the fabric cloth, in relation to the pocket stitching along the fold line.

As is best illustrated in FIG. 4 each of the pockets 30, 32 on one of the interior side portion is lined with the closed cell foam strip 44. When slats 14 are inserted along the side that faces the exterior the back side and bottom side of the chair slats are cushioned against the fabric. As a result, the slats wear against the cushion foam strip 44 rather than against the soft canvas material. This dramatically increases canvas life. And, there is no sacrifice to living hinge flexibility, or manufacturing ease. This coaction is not expected and uses a foam strip that is a material made for an entirely different purpose, i.e., weather stripping. One suitable foam strip material adhered with an adhesive on one side for use in this process is a material that is made by Duraco, Inc. of 7400 W. Industrial Dr., Forest Park, Ill. 60130, and one particular preferred strip is Volara® 2" strips. Another which may be used with equally satisfactory results is sold under the mark Poron®. Poron® is a closed cell foam that exhibits very low compression set, good shock absorbing performance and low out gassing. However a most preferred strip is a Duraco Nitrile PVC blend strip, product code CA002. This strip, as is Volara®, is suitable over a wide range of temperatures without sacrificing its compressibility and/or flexibility. An interesting anecdotal observation is that the foam seems to cushion, and even out a child's rocking and thus enhances the calming effect during use of the children's size for its therapeutic effect. Surprisingly, these benefits are achieved from a material designed for weather stripping, a use not at all suggestive of Applicant's constructional use in these foldable slat seat chairs.

EXAMPLE

To test the chairs use to provide calmness and the affect of deep pressure, the chair of FIG. 1 was studied for special needs children in a Buffalo, N.Y. school system.

Earlier deep pressure research has been completed using weighted vests or other devices. The FIG. 1 chair presumably supplies a similar type of deep pressure.

Deep pressure is discussed as part of the sensory integration theory. Sensory integration theory states that the proprioceptive, vestibular, and tactile systems re important for functioning, as well as the other sensory systems (Honaker, D., & Rossi, L. (2005). Proprioception and participation at school: Are weighted vests effective? *Sensory Integration Special Interest Section Quarterly: American Occupational Therapy Association, Inc.,* 28 (3), 1-4). These systems need to be registered and processed appropriately. According to Ayres (1979), if there is dysfunction, a behavioral outcome may be observed (as cited in Olson, L. J., & Moulton, H. J. (2004). Use of weighted vests in pediatric occupational therapy practice. *Physical & Occupational Therapy in Pediatrics,* 23, 45-60). According to VandenBerg, N. L. (2001) The use of a weighted vest to increase on-task behavior in children with attention difficulties. *American Journal of Occupational Therapy,* 55, 621-628, these behavioral outcomes may include shifting from activity to activity, being distracted by other stimulation in the room that is not relevant to current activity, restlessness or difficulty staying seated, poor quality school work, and frequency talking or touching peers.

Among these sensory systems, proprioception plays an important role in the principles of sensory integration. (Honaker, D., & Rossi, L. (2005). Proprioception and participation at school: Are weighted vests effective? *Sensory Integration Special Interest Section Quarterly American Occupational Therapy Association, Inc.,* 28 (3), 1-4). Proprioceptive input is said to influence sensory integration. Proprioception and deep pressure are carried by the dorsal column to the thalamus and the reticular formation. The reticular system plays and important role in arousal, which may explain the effect of deep pressure on arousal level (VandenBerg, N. L. (2001) The use of a weighted vest to increase on-task behavior in children with attention difficulties. *American Journal of Occupational Therapy,* 55, 621-628). Furthermore, deep pressure may stimulate and increase in the neurotransmitter Serotonin. Serotonin leads to calming of the central nervous system (VandenBerg, N. L. (2001) The use of a weighted vest to increase on-task behavior in children with attention difficulties. *American Journal of Occupational Therapy,* 55, 621-628). Proprioceptive, or deep pressure stimulation, may calm other sensitive systems such as the tactile and vestibular, and modulate arousal level (Honaker, D., & Rossi, L. (2005). Proprioception and participation at school: Are weighted vests effective? *Sensory Integration Special Interest Section Quarterly: American Occupational Therapy Association, Inc.,* 28 (3), 1-4).

As illustrated, the influence of deep pressure, a type of proprioceptive input, is believed to be beneficial to assist children in calming and organizing multisensory systems. Deep pressure can be provided through numerous activities. These include: weighted vests, weighted toys, backpacks, holding therapy, (Edelson, S. M., Edelson, M., Kerr, D., & Grandin, T. (1998). Behavioral and physiological effects of deep pressure on children with Autism: A pilot study evaluating the efficacy of Grandin's Hug Machine. *American Journal of Occupational Therapy,* 53, 145-152). These studies were implemented to test the deep pressure affects of the chair of FIG. 1, for special needs children in group circle activity.

During the first phase, participants were observed without the chairs to collect baseline data. The second phase required the provision of the chairs to the students for circle time when data was collected. The third phase required that the chairs be removed from circle time and observation continued. The fourth phase was the reinstating of the chairs. Observations were recorded. Each phase was a two week period. Two observation sessions occurred during each week resulting in 16 observation sessions.

The population from which the sample was derived was preschool students attending an elementary school in the Buffalo, N.Y. area. These children were all 4 years of age.

The sample was derived through the use of teacher recommendation. The researcher obtained list of five students in one of the preschool classrooms. The teacher was asked to list the five students who were believed to have difficulty paying attention in circle time. The teacher was provided with examples of inattention including frequent change of position (standing up or lying down when not instructed), decreased visual attention as compared to other children in the group, and position of the body away from the teacher.

Data collection was completed through the use of a checklist. The checklist was broken down into 1 minute intervals for a total time period of 15 minutes. Each behavior that is indicative of paying attention was assessed during each 1 minute period. Sixteen periods of recorded observation took place, two per week for eight weeks. The observations were held over an 8 week period as to attempt to minimize particular classroom changes or individual changes on the results. The purpose of the observations was to achieve an accurate assessment of the effects of the chairs.

The researchers attended the classroom during circle time a week before recorded observations were taken in order help to integrate their presence into circle time and decrease the amount of distraction of a novel individual during observation periods. The observer was trained in the use of the checklist data collection tool, and a test of competency was completed before the onset of the study. Inter-rater reliability was established prior to actual data collection.

Preschool-aged children were given the seat of FIG. 1 and their ability to attend during circle time was measured. Because the study was completed in the natural environment, there were many factors that were unable to be controlled for that influenced the children's ability to attend. Some of the children demonstrated some improved attending in the seats while other children's attending skills were unaffected by the seats. For those children who had the most notable improvement, the seats seemed to have greatest impact on visual attending and facing the teacher. This is most likely attributed to the physical design of the seats that provided a measure of physical confinement.

Despite the many variables, it was noticed and observed that there was a consistent improvement in visual attending and facing the teacher when the children were in the seats. Generally attending behaviors improved over the course of study for these special needs students.

Tests were done on the seats with new hinge here described. We allowed for 8-10 weeks of steady usage in two schools: Turner Elementary in Turner, Me., and River Valley Charter School in Newburyport, Mass. Both classrooms utilized the trial seats with children who rocked and rolled the most and found absolutely no wear to the hinge.

From the foregoing it can be seen that the chairs herein constructed accomplishes all of its stated objectives.

What is claimed is:

1. A foldable and portable chair having a back and a seat each formed of a plurality of substantially parallel slats, said slats having opposite ends, comprising:

a first flexible connecting material having defined pockets therein for receipt of one end of said slats of said back;

a second flexible connecting material having defined pockets therein for receipt of one end of said slots of said seat;

a third flexible connector material defining a fold line hinge and having defined pockets therein adapted for receipt of the other end of said back and seat slats to form a flexible connected set of back and seat slats;

each of said pockets having an interior and exterior pocket wall; collapsible straps attached to the slats of the back and the slats of the seat to hold the back and seat in proper relation for use;

said third flexible connector having a foam cushion in it which lies across the fold line hinge, but not over a predominant surface area of the back and seat slats.

2. The chair of claim 1 wherein the foam cushion is a closed cell foam material.

3. The chair of claim 2 wherein the cell foam material is a closed cell polyolefin.

4. The chair of claim 3 wherein the cell foam material is a strip with adhesive on one side so that it may be laid over the fold line along its long axis.

5. The chair of claim 4 wherein the cell foam material is comprised of closed cell polyolefin weather stripping material.

6. The chair of claim 1 wherein said slats are of basswood.

7. The chair of claim 1 wherein said flexible material is a fabric material.

8. The chair of claim 7 wherein said flexible fabric material is canvas.

9. The chair of claim 7 wherein said pockets are stitched pockets integrally formed in said canvas.

10. The chair of claim 9 wherein each end of said slat is glued to its respective pocket.

11. The chair of claim 9 wherein said straps are glued to the slats.

12. A method of calming a child in need thereof, comprising:

providing a first flexible connecting material having defined pockets therein for receipt of one end of said slats of said back;

a second flexible connecting material having defined pockets therein for receipt of one end of said slots of said seat;

a third flexible connector material defining a fold line hinge and having defined pockets therein adapted for receipt of the other end of said back and seat slats to form a flexible connected set of back and seat slats;

each of said pockets having an interior and exterior pocket wall; collapsible straps attached to the slats of the back and the slats of the seat to hold the back and seat in proper relation for use;

said third flexible connector having a foam cushion in it which lies across the fold line hinge, but not over a predominant surface area of the back and seat slats;

placing a child in a chair;

adjusting the collapsible straps so the chair hugs the child; and rocking the child back and forth in said chair.

* * * * *